US011905809B2

(12) United States Patent
Davies et al.

(10) Patent No.: US 11,905,809 B2
(45) Date of Patent: Feb. 20, 2024

(54) DETERMINING RESERVOIR HETEROGENEITY FOR OPTIMIZED DRILLING LOCATION

(71) Applicant: Landmark Graphics Corporation, Houston, TX (US)

(72) Inventors: Andrew Davies, West Hagbourne (GB); Michael Simmons, Wantage (GB); Lawrence Cowliff, Chartham (GB); Estanislao Nicolás Kozlowski, Abingdon (GB)

(73) Assignee: Landmark Graphics Corporation, Houston, TX (US)

( * ) Notice: Subject to any disclaimer, the term of this patent is extended or adjusted under 35 U.S.C. 154(b) by 72 days.

(21) Appl. No.: 17/679,996

(22) Filed: Feb. 24, 2022

(65) Prior Publication Data

US 2023/0265750 A1 Aug. 24, 2023

(51) Int. Cl.

| | |
|---|---|
| ***E21B 43/25*** | (2006.01) |
| ***E21B 43/16*** | (2006.01) |
| ***E21B 47/003*** | (2012.01) |
| ***E21B 47/0224*** | (2012.01) |
| ***E21B 49/00*** | (2006.01) |

(52) U.S. Cl.

CPC ..... *E21B 43/25* (2013.01); *E21B 43/16* (2013.01); *E21B 47/003* (2020.05)

(58) Field of Classification Search

CPC ..... E21B 2200/20; E21B 49/00; E21B 44/00; E21B 47/00; E21B 47/01; G01V 99/005; G01V 1/306; G01V 1/50; G01V 11/00; G01V 2210/624; G01V 2210/6169

See application file for complete search history.

(56) References Cited

U.S. PATENT DOCUMENTS

| | | | |
|---|---|---|---|
| 7,277,796 | B2 | 10/2007 | Kuchuk et al. |
| 2009/0194274 | A1 | 8/2009 | Del Castillo et al. |
| 2012/0316789 | A1 | 12/2012 | Suarez-Rivera et al. |
| 2013/0132052 | A1* | 5/2013 | Hogg ..... G06T 17/05 703/6 |
| 2018/0195378 | A1* | 7/2018 | Hu ..... E21B 47/005 |
| 2019/0025461 | A1 | 1/2019 | Wiener et al. |

(Continued)

OTHER PUBLICATIONS

International Search Report and Written Opinion, PCT/US2022/017732, dated Nov. 11, 2022, 9 pages.

(Continued)

*Primary Examiner* — Zakiya W Bates

(74) *Attorney, Agent, or Firm* — Kilpatrick Townsend & Stockton LLP

(57) ABSTRACT

A system can determine a heterogeneity and a score for a reservoir for optimizing a drilling location. The system can receive a wireline log associated with a well that is positioned in a subterranean formation that includes a reservoir. The system can determine, using the wireline log, at least one statistical parameter for an interval of the well. The system can determine, using the at least one statistical parameter, a vertical heterogeneity of the reservoir. The system can determine, using the vertical heterogeneity, a score associated with the reservoir. The score can indicate an extraction difficulty and a carbon intensity of the reservoir. The system can output the score for optimizing a drilling location.

20 Claims, 6 Drawing Sheets

(56) References Cited

U.S. PATENT DOCUMENTS

| | | | |
|---|---|---|---|
| 2021/0302620 | A1 | 9/2021 | Hern et al. |
| 2021/0349238 | A1 | 11/2021 | Hamam et al. |

OTHER PUBLICATIONS

Fitch et al., "An integrated and quantitative approach to petrophysical heterogeneity", Mar. Petrol. Geol., 63, 2015, pp. 82-96.

* cited by examiner

DETERMINING RESERVOIR HETEROGENEITY FOR OPTIMIZED DRILLING LOCATION

TECHNICAL FIELD

The present disclosure relates generally to wellbore operations and, more particularly (although not necessarily exclusively), to determining a heterogeneity of a reservoir for optimizing drilling location.

BACKGROUND

A wellbore can be formed in a subterranean formation for extracting various material such as hydrocarbon material. The subterranean formation may include one or more reservoirs that include the hydrocarbon material. An exploration operation can involve determining hydrocarbon well placement locations with respect to the subterranean formation or other suitable operations. Hydrocarbon well performance can be affected by well placement. For example, placing a hydrocarbon well proximate to a first reservoir may yield better results than placing the hydrocarbon well proximate to a second reservoir. But, characterizing one or more reservoirs in the subterranean formation can be difficult.

DETAILED DESCRIPTION

Figure 1:
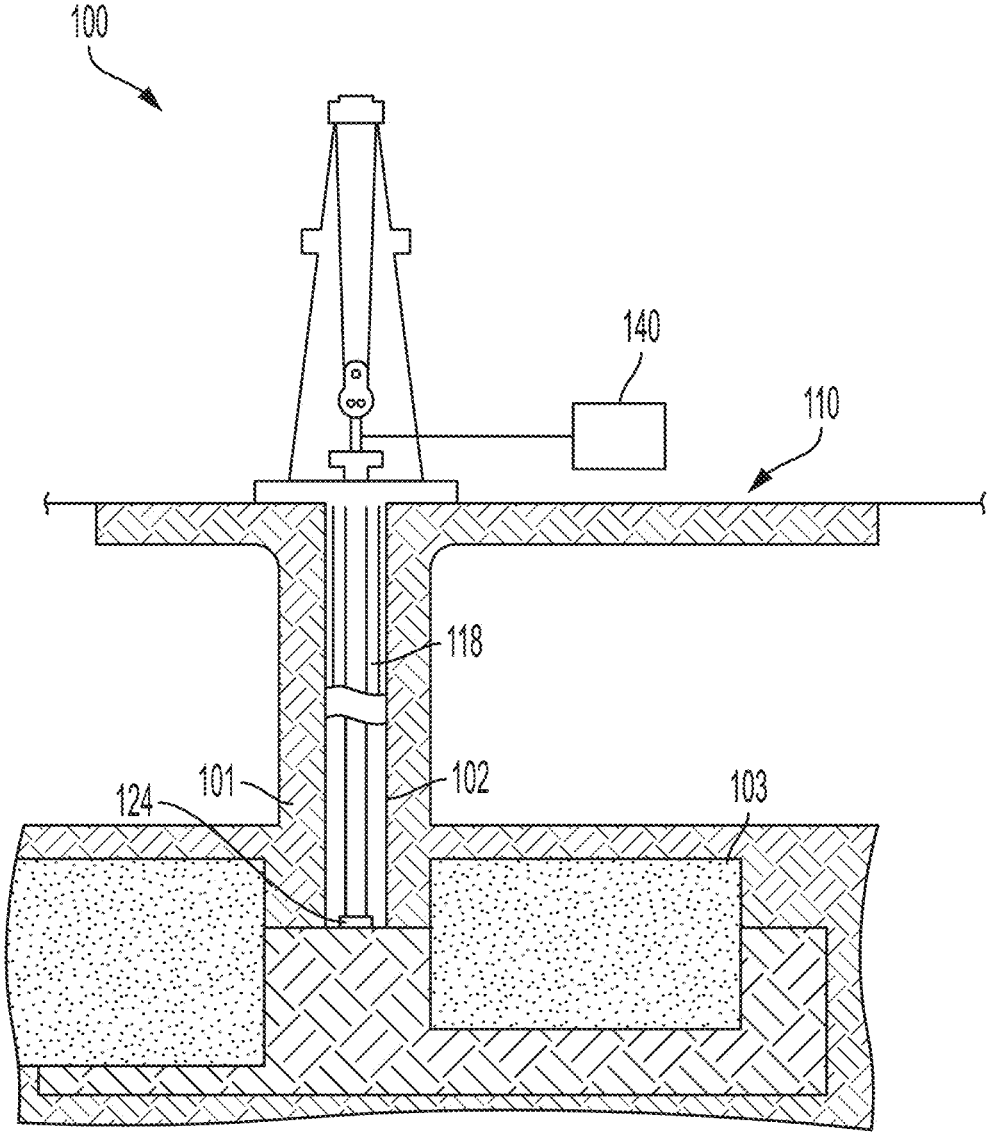
FIG. 1 is a sectional side-view of a well that is positioned in a subterranean formation that includes a reservoir according to one example of the present disclosure.

Certain aspects and examples of the present disclosure relate to determining a heterogeneity of a reservoir of a subterranean formation and determining a score, based on the heterogeneity, associated with the reservoir for optimizing a drilling location. The reservoir may be a porous and permeable subsurface body of rock that can accumulate and store hydrocarbons, such as crude oil. The heterogeneity of the reservoir can be determined by analyzing a wireline log that may be obtained from a well that may be positioned in the subterranean formation, for example, for extracting the hydrocarbons or other suitable material from the reservoir. The wireline log may include a continuous set of recorded data that can be obtained from a sensor that can be positioned in the well. The data may include porosity data, permeability data, other suitable data, or any combination thereof. The heterogeneity can include a vertical heterogeneity that may indicate a lithological variation in the rock record. The vertical heterogeneity may be used to determine a score, which may indicate a carbon intensity, production efficiency, an extraction difficulty, or any suitable combination thereof that may be associated with the reservoir. The carbon intensity associated with a reservoir may be an amount of CO2 that may be emitted to produce one unit of hydrocarbon from the reservoir.

The heterogeneity may additionally include a lateral heterogeneity component. Lateral heterogeneity can be determined by analyzing multiple wells in one or more reservoirs. The vertical heterogeneity can be used to indicate whether a first reservoir is an analogue of a second reservoir and thereby determine lateral heterogeneity in areas with low data density. In some examples in which seismic data may be used, a seismic-scale heterogeneity associated with the reservoir may also be determined. The seismic-scale heterogeneity of the reservoir can include a density of observable faults per unit volume in the reservoir or any other suitable measure of the reservoir.

The character of a geological reservoir may determine how the geological reservoir can behave when fluids are extracted from, or injected into, the geological reservoir. One variable that may be considered when determining the character of the reservoir can include a degree of heterogeneity. The heterogeneity can be a function of a lithological variation in the rock record. The lithological variation can occur due to depositional processes and post-depositional impacts, such as physical or chemical changes, that can occur during a conversion of sediment to sedimentary rock. The changes can occur in three dimensions, and heterogeneity can, therefore, be understood in terms of vertical heterogeneity and lateral heterogeneity.

Heterogeneous reservoirs can pose more challenges than homogenous reservoirs. Thus, determining whether a reservoir is heterogeneous or homogeneous may be useful for assessing exploration opportunities, evaluating exploration wells and appraisal wells, creating static reservoir models and dynamic reservoir models, performing other wellbore operations, or any suitable combination thereof. Heterogeneity can be used for evaluating a potential carbon intensity of reservoirs in oil and gas fields and a suitability of a site for subsurface carbon storage. In some examples, wireline logs can be used for generating metrics for characterizing a heterogeneity of a reservoir. The metrics can be combined into a single coefficient of heterogeneity that can be used for evaluation, for screening, for identifying analogue reservoirs from which 3D reservoir models can be generated, and the like. The lateral heterogeneity can also be generated from wireline logs by assessing a distance over which correlations can be meaningful. In some examples, the wireline log can be analyzed using derived parameters, which may include porosity data or permeability data, of the wireline log.

For an interval in a well, a metric or statistical parameter can be determined that can be used to determine a vertical heterogeneity for the well. One example of the statistical parameter can include a population variance, which can provide insights into a broad-scale heterogeneity of the reservoir. A dataset can be determined that includes a difference ("delta data") between each consecutive pair of samples of the wireline log. In some examples, delta data can include a difference between any other suitable pair of samples of the wireline log. A variance ("delta variance") of the delta data can be determined. The delta variance can be more granular than the population variance and can provide more detailed knowledge related to the vertical heterogeneity of the reservoir. Determining the delta variance can yield information on a frequency of variability in the reservoir. An effective range for each well in the reservoir can be determined. The effective range can be a distance above which variance does not increase. Once determined, the effective range can provide insights into bed thicknesses associated with reservoirs.

A distance over which correlations between wells can be meaningful can be assessed for determining information related to lateral heterogeneity. A distance at which lateral correlations become chaotic can provide a length scale of a lateral heterogeneity of a reservoir. In areas in which data density may be insufficient, representative metrics for the reservoir can be obtained by performing a vertical heterogeneity analysis on analogue reservoirs.

The calculated metrics can be combined to provide a single function that can describe vertical heterogeneity, lateral heterogeneity, total heterogeneity, other suitable measures of heterogeneity, or any suitable combination thereof. In some examples, the total heterogeneity can be a combination of lateral heterogeneity and vertical heterogeneity. The function may allow different reservoirs to be compared quantitatively and may support decision-making related to optimizing a drilling location or for controlling wellbore operations. When combined with other metrics, such as quality and thickness, the vertical heterogeneity can also be used to determine a score that can indicate a carbon intensity of a reservoir, a production efficiency of the reservoir, other suitable indications, or any suitable combination thereof. The score may be used to support decision making related to optimize the drilling location, the placement of subsequent wells, or related to controlling wellbore operations. The score can also be used to identify suitable analogues to support reservoir modelling and predictive performance benchmarking.

In some examples, techniques for determining one or more measures of heterogeneity may involve analyzing wireline logs, derived parameters such as porosity or permeability, or a combination thereof. Various measures of heterogeneity can be assessed depending on the parameters or wireline logs used. In some examples, sedimentological properties or reservoir properties may be determined from the heterogeneity. In some examples, the sampling rate of at least one wireline log may be standardized. The standardized sampling rate can include a shortest sampling rate that is common to each relevant well to be considered. An interval of the well to be analyzed can be based on tables of geological formations, reservoir units, seismic reflectors, sequence stratigraphic surfaces, or any suitable combination thereof.

In some examples, a population variance can be determined for the wireline log data for the interval of the well. The population variance can include a total variance in the interval of interest and can provide insights into the heterogeneity of the reservoir. But, the total variance may not provide information on detailed, fine scale heterogeneity in the reservoir. To address this, delta data can be determined, and the delta data may include differences between each successive sample downhole. Additionally, the variance (e.g., delta variance) on the delta data can be determined. The delta variance can provide information related to the frequency of variability, which can be related to the heterogeneity of the reservoir.

An effective range can be determined from the wireline data using a standardized 1D variogram. The effective range can be the distance beyond which observations can no longer be spatially correlated. The effective range may be determined using a model that can be fitted to semi-variance data of the wireline log and that may involve a standardized approach. Each parameter or wireline log associated with the reservoir can be used to determine an estimate of effective range for the reservoir that can correspond to each respective parameter or wireline log.

In some examples, wireline logs can be used to determine a lateral heterogeneity between a first reservoir (e.g., via a first well) and a second reservoir (e.g., via a second well) by assessing a distance (e.g., the effective range) over which correlations between reservoirs may be meaningful. The first reservoir may be the same or different from the second reservoir. Randomized synthetic logs can be generated for determining the lateral heterogeneity among the first well and the second well. For example, real well logs may be blocked at a prescribed scale to generate characteristic stratigraphic units. Discrete wireline facies classes can be determined through cluster analysis that may use thickness and mean wireline log values. A transition matrix can be generated for the defined clusters. A random sample can be selected from one of the clusters to initiate a base of a synthetic well. New samples can be added to the base of the synthetic well using the transition matrix until the desired synthetic well thickness is achieved. The described techniques can be repeated to generate one or more additional synthetic wireline logs.

In some examples, dynamic time warping can be used to automatically correlate a synthetic log to an actual wireline log. A correlation coefficient for the sample pairs from the two logs can be determined. The dynamic time warping and determination of the correlation coefficient can be repeated one or more times for the several synthetic logs and can be used for generating a histogram of correlation coefficients that can describe a space of non-meaningful correlations.

A correlation coefficient can be calculated for the first well and the second well. The correlation coefficients of actual wireline logs can be compared to the synthetic logs. A distance at which there may be substantial overlap with the histogram from the synthetic wells can provide information on the length scale of lateral heterogeneity between the first well and the second well.

In some examples, different parameters associated with a well can be combined to quantify different aspects of heterogeneity. Variance and delta variance can be combined into a single function that can provide detailed insights into vertical heterogeneity, and the distance in which meaningful correlations break down can allow lateral heterogeneity to be quantified. Lateral heterogeneity indices and vertical heterogeneity indices can be combined into a total heterogeneity index. One or more total heterogeneity indices can be plotted so that trends can be discernable and can support decisions related to exploration or wellbore operations. When combined with other metrics, such as quality and thickness, the heterogeneity indices may also be used to determine a score associated with a reservoir that can be related to an overall carbon intensity of the reservoir. The indices can also be used to identify suitable analogue reservoirs in well data, outcrop data, or 3D models. Analogue reservoirs can be identified using distance measures, k-means clustering, or other suitable techniques. Analogue reservoirs can be used for reservoir modelling and for predictive reservoir performance and carbon intensity benchmarking.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a sectional side-view of a well 100 positioned in a subterranean formation 101 that includes a reservoir 103 beneath a surface 110 according to one example of the present disclosure. The reservoir 103 may be a porous and permeable body of rock that can accumulate and store hydrocarbons, such as crude oil. The reservoir 103 may be encapsulated by, or otherwise dispersed within, the subterranean formation 101. The well 100 may include a wellbore 102 that can be drilled into, or otherwise formed in, the subterranean formation 101 for accessing the reservoir 103. The well 100 may extract hydrocarbons from the reservoir 103 (or other suitable sources in the subterranean formation 101) via the wellbore 102. A difficulty associated with extracting the hydrocarbons from the reservoir 103 may depend on a vertical heterogeneity of the reservoir 103. For example, a heterogeneous reservoir may be more difficult from which to extract material than a homogeneous reservoir. Reservoirs that can be difficult to extract hydrocarbons from may result in an increased carbon intensity. Accordingly, production-related wellbore operations in heterogeneous reservoirs may cause more carbon emissions than production-related wellbore operations in homogeneous reservoirs to produce similar units of energy.

The wellbore 102 may include a wireline 118 that can be used to lift or lower equipment, such as a sensor 124. The sensor 124 may be communicatively coupled, by the wireline 118, to a computing device 140 that can be used to generate a wireline log. In some examples, the wireline log can include a record of continuous measurements that can be related to formation properties of the reservoir 103 that can be taken by the sensor 124. The sensor 124 may be coupled to a logging tool that can be positioned downhole and coupled to the wireline 118 for lifting or lowering the logging tool in the wellbore 102. In some examples, the wireline log can include electrical measurements, sonic measurements, nuclear measurements, caliper measurements, formation fluid measurements, rheological measurements, pressure measurements, porosity measurements, permeability measurements, or any combination thereof.

In some examples, the wireline log data can be analyzed to determine the vertical heterogeneity of the reservoir 103. In some examples, an analysis of the wireline log data to determine the vertical heterogeneity of the reservoir 103 can be performed by the computing device 140. Analyzing the wireline log data to determine the vertical heterogeneity of the reservoir can involve calculating a statistical parameter of the wireline log data. In some examples, the statistical parameter can include a variance, which can indicate how far data points in the wireline log may be spread out from an average value for the data points in the wireline log. The variance can provide insights on broad features related to the vertical heterogeneity. Additionally or alternatively, the statistical parameter may include a standard deviation, a covariance, a mean, a median, or any other similar statistic.

A delta data dataset of differences between consecutive samples in the wireline log data can be generated to provide more detail. For example, a delta variance can be calculated for the delta data and can be used to provide more granular information on the vertical heterogeneity of the reservoir 103. The vertical heterogeneity can be used to determine a score of the reservoir 103 that may indicate a potential carbon intensity of the reservoir 103, a potential extraction difficulty of the reservoir 103, or a combination thereof. The score may be used to optimize a drilling location or to control other suitable wellbore operations that may be associated with the reservoir 103. The score may be used to determine whether to drill an additional wellbore into the reservoir 103 for extracting hydrocarbons from the reservoir 103. The score may also be used to decide whether to begin a production process that may be associated with wells in the reservoir 103. The wellbore operations may also include performing additional exploratory operations for collecting more data. In some examples where seismic data may be used, a seismic-scale heterogeneity associated with the reservoir 103 may also be determined. The seismic-scale heterogeneity of the reservoir 103 can be a density of observable faults per unit volume in the reservoir and can indicate a stability or stress state of the subterranean rock formation.

Figure 2:
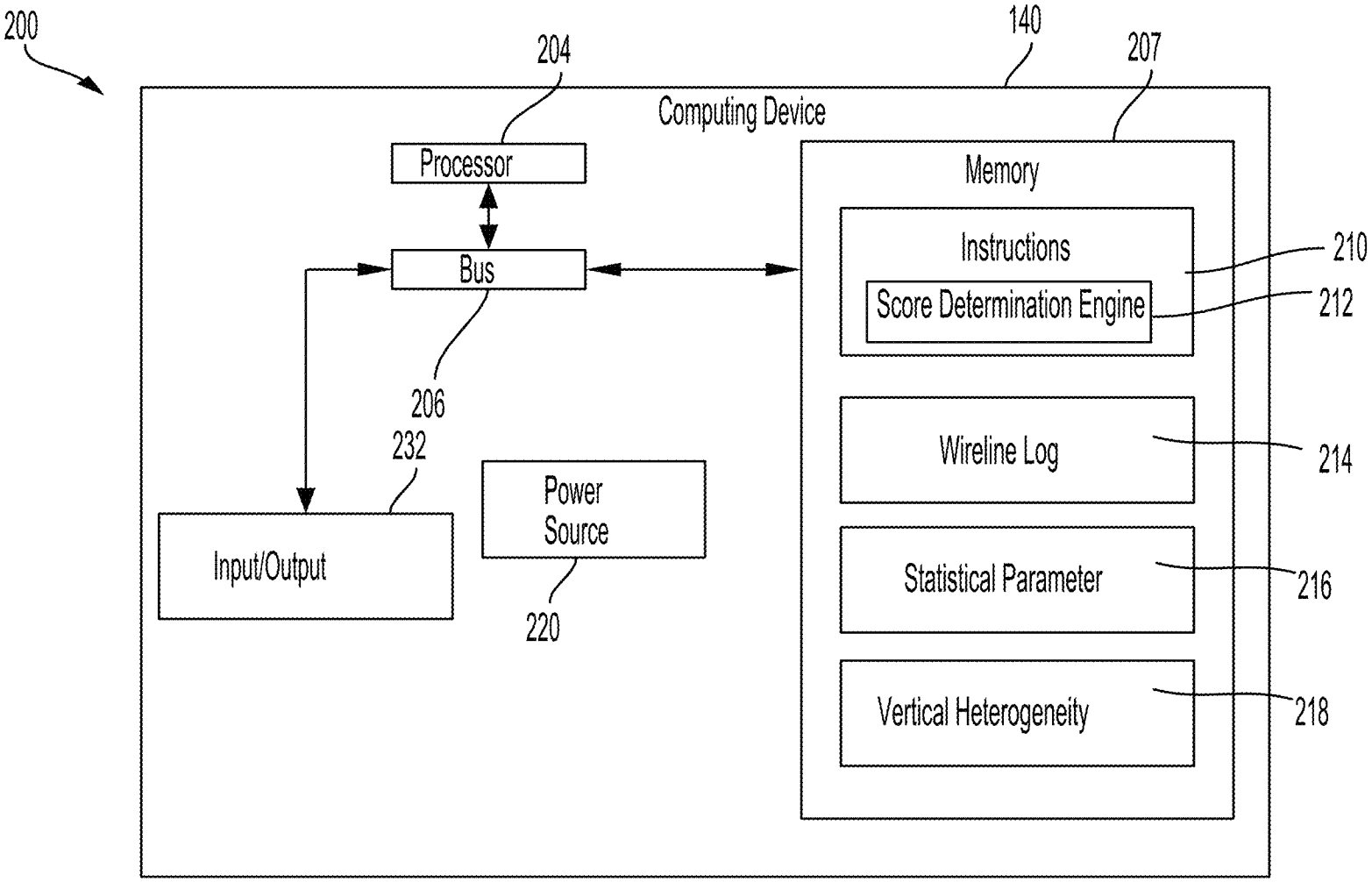
FIG. 2 is a block diagram of a computing device for determining reservoir heterogeneity according to one example of the present disclosure.

FIG. 2 is a block diagram of a computing system 200 that can be used for determining a vertical heterogeneity and a score for a reservoir 103 according to one example of the present disclosure. The components shown in FIG. 2, such as the processor 204, memory 207, power source 220, communications device 201, and the like may be integrated into a single structure such as within a single housing of a computing device 140. Alternatively, the components shown in FIG. 2 can be distributed from one another and in electrical communication with each other.

The computing system 200 may include the computing device 140. The computing device 140 can include a processor 204, a memory 207, and a bus 206. The processor 204 can execute one or more operations for analyzing data from a wireline log 214 for determining a vertical heterogeneity 218 of a reservoir. The processor 204 can execute instructions stored in the memory 207 to perform the operations. The processor 204 can include one processing device or multiple processing devices or cores. Non-limiting examples of the processor 204 include a Field-Programmable Gate Array ("FPGA"), an application-specific integrated circuit ("ASIC"), a microprocessor, etc.

The processor 204 can be communicatively coupled to the memory 207 via the bus 206. The non-volatile memory 207 may include any type of memory device that retains stored information when powered off. Non-limiting examples of the memory 207 may include EEPROM, flash memory, or any other type of non-volatile memory. In some examples, at least part of the memory 207 can include a medium from which the processor 204 can read instructions. A computer-readable medium can include electronic, optical, magnetic, or other storage devices capable of providing the processor 204 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions can include processor-specific instructions generated by a compiler or an interpreter from code written in any suitable computer-programming language, including, for example, C, C++, C #, etc.

In some examples, the memory 207 can be a non-transitory computer readable medium and can include computer program instructions 210 for determining the vertical heterogeneity 218 of the reservoir. For example, the computer program instructions 210 can include a score determination engine 212 that can be executed by the processor 204 for causing the processor 204 to perform various operations. In some examples, the memory may include a wireline log 214. The wireline log 214 can include a record of a continuous measurement that can be related to formation properties of the reservoir that can be obtained with a sensor. In some examples, the wireline log 214 can include electrical measurements, sonic measurements, nuclear measurements, caliper measurements, formation fluid measurements, rheological measurements, pressure measurements, porosity measurements, permeability measurements, or any combination thereof. The measurements may be obtained at or converted to a standardized sample rate. For example, the wireline log 214 may include a strip of paper or a similar medium. In some examples, the wireline log 214 may be digital data. The sensor may be coupled to a logging tool that can be positioned downhole in a wellbore and coupled to a wireline for lifting or lowering the logging tool in the wellbore.

The instructions 210 may cause the processor 204 to perform operations related to analyzing the wireline log 214 to determine the vertical heterogeneity 218 of the reservoir and a score associated with the reservoir. For example, the score determination engine 212 can receive wireline log 214 data from the sensor or tool that may be positioned downhole. The score determination engine 212 may also determine the statistical parameter 216 for determining the vertical heterogeneity 218 of the reservoir. The score determination engine can, using the vertical heterogeneity 218, determine a score associated with the reservoir that may indicate an extraction difficulty or a carbon intensity of the reservoir.

The computing device 140 can include a power source 220. The power source 220 can be in electrical communication with the computing device 140 and the communications device 201. In some examples, the power source 220 can include a battery or an electrical cable (e.g., a wireline). The power source 220 can include an AC signal generator. The computing device 140 can operate the power source 220 to apply a transmission signal to the antenna 228 to generate electromagnetic waves that convey data to other systems. For example, the computing device 140 can cause the power source 220 to apply a voltage with a frequency within a specific frequency range to the antenna 228. This can cause the antenna 228 to generate a wireless transmission. In other examples, the computing device 140, rather than the power source 220, can apply the transmission signal to the antenna 228 for generating the wireless transmission.

Figure 3:
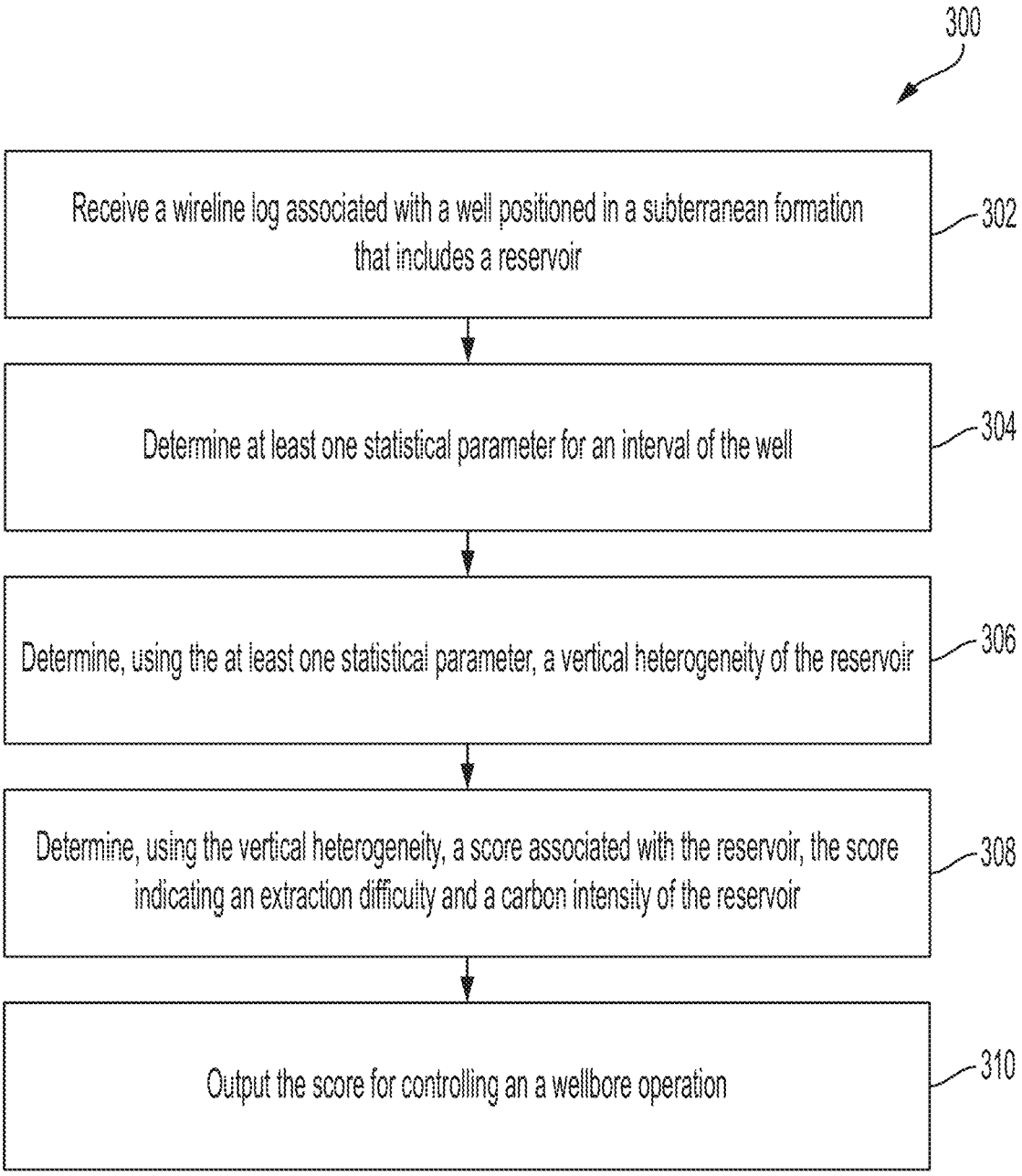
FIG. 3 is a flow chart of a method for determining a vertical heterogeneity of a reservoir according to one example of the present disclosure.

FIG. 3 is a flow chart of a process 300 for determining a vertical heterogeneity and a score according to one example of the present disclosure. At block 302, the computing device 140 receives a wireline log associated with a well that is positioned in a subterranean formation that includes a reservoir. The wireline log can include data gathered from electrical measurements, sonic measurements, nuclear measurements, caliper measurements, formation fluid measurements, porosity measurements, permeability measurements, or any combination thereof. The measurements may be obtained by electrically powered instruments that can be positioned in the well. For example, the measurements may be obtained by a logging tool that may be coupled to a sensor. The wireline log may be obtained at or converted to a standardized sample rate. The standardized sample rate may allow the wireline log to be compared with other wireline logs obtained at or converted to the standardized sample rate. The computing device 140 can receive the wireline log wirelessly or by using a wired connection.

At block 304, the computing device 140 determines at least one statistical parameter for an interval of the well. In some examples, the statistical parameter can include a population variance, which can indicate how far data points in the wireline log may be spread out from an average value for the data points in the wireline log. The population variance can provide insights on broad features related to the vertical heterogeneity. Additionally or alternatively, the statistical parameter may include a standard deviation, a covariance, a delta variance, a mean, a median, or any other similar statistical parameter.

At block 306, the computing device 140 determines, using the at least one statistical parameter, the vertical heterogeneity of the reservoir. The delta data, the delta variance, other suitable information, or any suitable combination thereof can be used to determine the vertical heterogeneity. The vertical heterogeneity can indicate a lithological variation in a rock record of the reservoir and may provide insights into the structural complexity and variability of the reservoir. The vertical heterogeneity can also be used to determine the score for the reservoir.

At block 308, the computing device 140 determines, using the vertical heterogeneity, the score indicating a carbon extraction difficulty and a carbon intensity of the reservoir. In some examples, the score may be a total heterogeneity index that can include information related to the vertical heterogeneity of the reservoir, information related to the lateral heterogeneity of the reservoir, or a combination thereof. The score can be a relative advantage score that can provide an estimate of a carbon extraction difficulty or carbon intensity. In some examples, the score can be displayed in a graphical user interface for making decisions related to wellbore operations.

At block 310, the computing device 140 outputs the score for controlling a wellbore operation. The computing device 140 may be use the score to control the wellbore operation when drilling a wellbore (or performing other suitable operations) in the reservoir for extracting hydrocarbons from the reservoir. For example, the score may be used to determine whether (or where) to initiate a wellbore drilling operation in a particular reservoir. In some examples, the score can be used to determine an optimized placement of a wellbore. The score can indicate a difficulty of extracting hydrocarbon material from the reservoir, a carbon intensity of the reservoir, other suitable measures, or any combination thereof. Thus, the computing device 140, or other suitable devices or entities, can use the score to adjust a trajectory, a depth, or other suitable parameters relating to a drilling operation with respect to the reservoir. Controlling the wellbore operation may also include completing the wellbore for beginning an appraisal process or a production process for extracting hydrocarbons in the reservoir. In some examples, the score may be used for making decisions related to a hydrocarbon exploration operation for exploring properties related to the reservoir. For example, a hydrocarbon exploration operation may include a gravity survey for obtaining gravimetric profile of the rock formation containing the reservoir, a magnetic survey, a passive seismic survey, or an active seismic survey.

Figure 4:
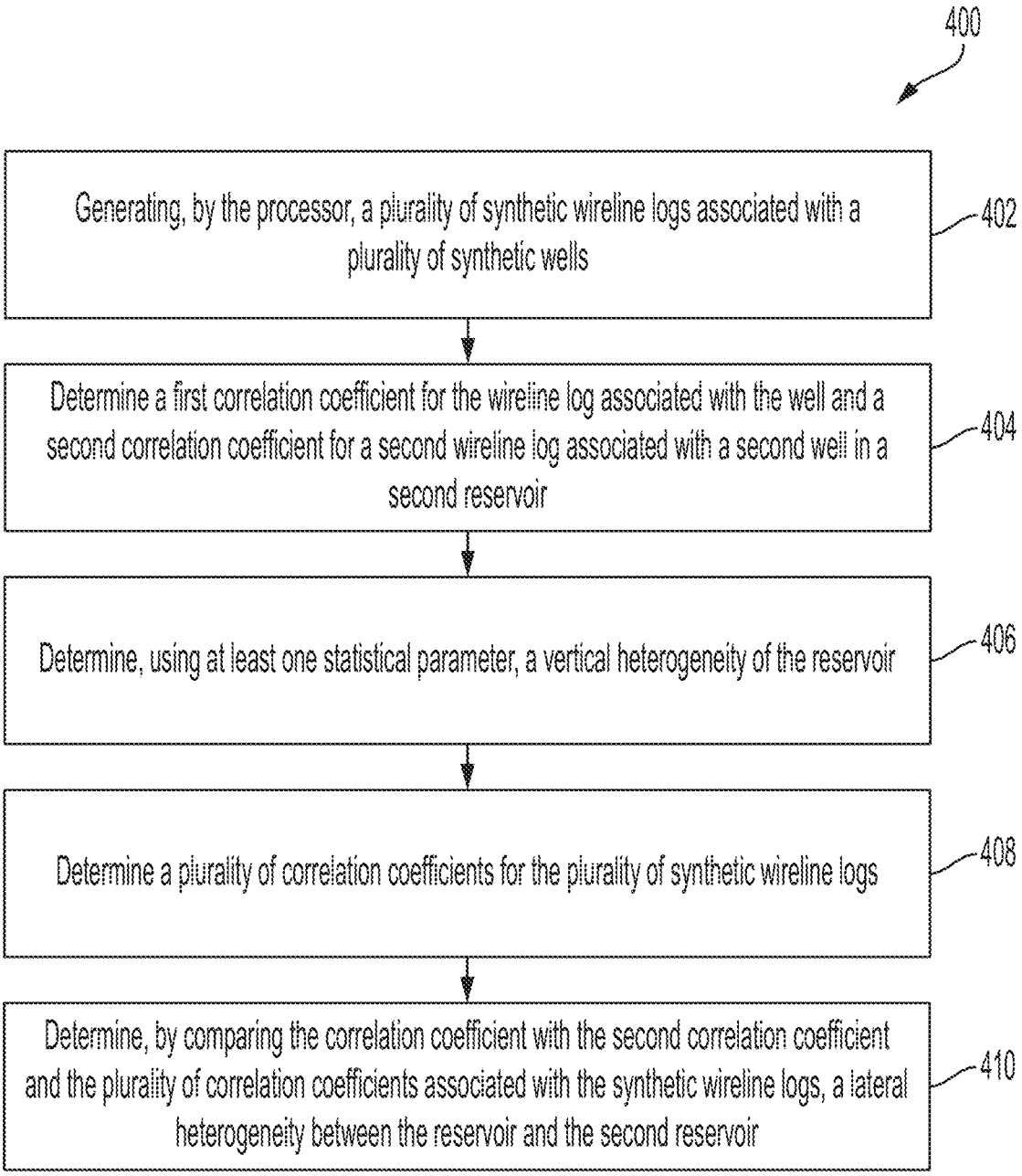
FIG. 4 is a flow chart of a method for determining a lateral heterogeneity among two or more reservoirs according to one example of the present disclosure.

FIG. 4 is a flow chart of a process 400 for determining a lateral heterogeneity among two reservoirs according to one example of the present disclosure. At block 402, the computing device 140 generates a plurality of synthetic wireline logs associated with a plurality of synthetic wells. The synthetic wireline logs can be generated by layering random samples on bases of the synthetic wireline logs via a transition matrix. The random samples can be layered on each of the synthetic wireline logs until a desired thickness is achieved. The synthetic wireline logs can be compared with actual wireline logs. Comparisons of the synthetic wireline logs with the actual wireline logs can be used for determining a space of non-meaningful correlations.

At block 404, the computing device 140 determines a first correlation coefficient for the wireline log associated with the first well, and a second correlation coefficient for a second wireline log associated with a second well in a second reservoir. The correlation coefficient for two wireline logs can be determined by determining a covariance among the two wireline logs and dividing the covariance by a product of the standard deviation of each of the two wireline logs.

At block 406, the computing device 140 determines, using at least one statistical parameter, a vertical heterogeneity of the reservoir. The vertical heterogeneity can indicate a lithological variation in a rock record of the reservoir and may provide insights into the structural complexity and variability of the reservoir. The vertical heterogeneity can also be used to determine the score for the reservoir.

At block 408, the computing device 140 determines a plurality of correlation coefficients for the plurality of synthetic wireline logs. The plurality of correlation coefficients for the synthetic wireline logs can be determined by determining a covariance among the synthetic wireline logs and dividing the covariance by a product of the standard deviation of each of the two wireline logs. The correlation coefficients may include absolute values or magnitude values of the correlation coefficients, which may indicate a strength of a correlation between the synthetic wireline logs.

At block 410, the computing device 140 determines, by comparing the correlation coefficient with the second correlation coefficient and the plurality of correlation coefficients associated with the synthetic wireline logs, a lateral heterogeneity between the reservoir and the second reservoir. The lateral heterogeneity may include a length scale or distance at which correlations may be meaningful. The lateral heterogeneity may be used for determining whether two reservoirs may be analogues. A mature reservoir that may be an analogue of a less mature reservoir may be used to provide insights into a production behavior associated with a production behavior of the less mature reservoir. In other words, properties of a well-studied analogue can be used to estimate properties of a less-studied analogue.

Figure 5:
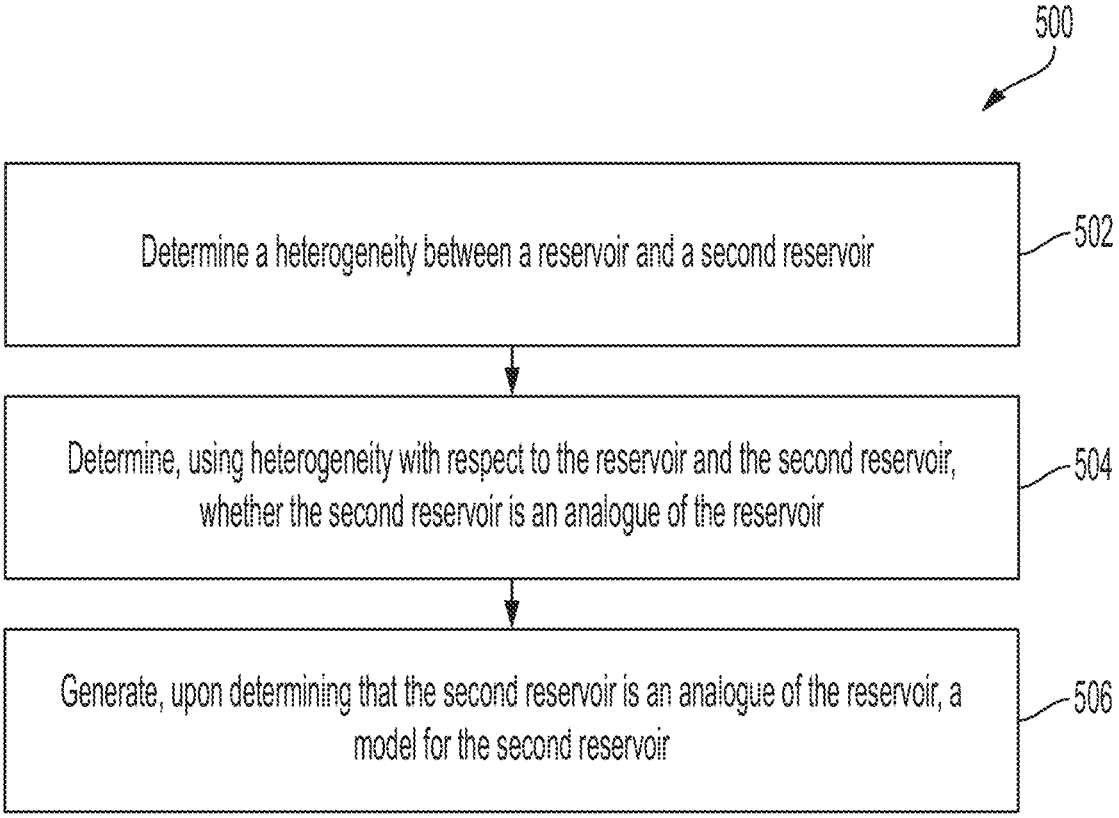
FIG. 5 is a flow chart of a method for determining an analogue of a reservoir using heterogeneity according to one example of the present disclosure.

FIG. 5 is a flow chart of a process 500 for determining an analogue of a reservoir using heterogeneity. At block 502, the computing device 140 determines a heterogeneity between the reservoir and a second reservoir. In some examples, the computing device 140 can determine the heterogeneity between the reservoir and any other suitable amounts (e.g., two, three, four, five, etc.) of other reservoirs. The heterogeneity may be a vertical heterogeneity, a lateral heterogeneity, other suitable type of heterogeneity, or any combination thereof. The lateral heterogeneity may indicate whether correlations between a first well in the reservoir and a second well in the second reservoir may be meaningful. The lateral heterogeneity may be combined with a vertical heterogeneity or other suitable heterogeneity of the reservoir to determine a total heterogeneity index or metrics for the reservoir.

In some examples, the vertical heterogeneity (e.g., as determined via the process 300) can be used to determine the lateral heterogeneity. For example, the vertical heterogeneity of the reservoir can be used by the computing device 140 to determine that the second reservoir is an analogue of the reservoir. Accordingly, the computing device 140 can determine lateral heterogeneity metrics with respect to the reservoir, the second reservoir, or a combination thereof. In some examples, the vertical heterogeneity, the lateral heterogeneity, other suitable heterogeneity metrics, or any suitable combination thereof can be combined into heterogeneity metrics.

At block 504, the computing device 140 determines, using the heterogeneity metrics, whether the second reservoir is an analogue of the reservoir. In some examples, whether the second reservoir is an analogue of the reservoir can be determined using distance measures, k-means clustering, other spatial classification algorithms, or any suitable combination thereof. In some examples, the computing device 140 can use the vertical heterogeneity to determine that the second reservoir is the analogue of the reservoir. Additionally or alternatively (e.g., in examples in which few well penetrations are formed in the reservoir or the second reservoir), the computing device 140 can use the lateral heterogeneity to determine whether the second reservoir is the analogue of the reservoir. The computing device 140 can use any combination of information of the heterogeneity metrics to determine that the second reservoir is the analogue of the reservoir. In some examples, the computing device 140 may determine whether the second reservoir is an analogue of the reservoir by using machine-learning techniques.

By determining that the second reservoir is the analogue of the reservoir, the computing device 140 may additionally determine general insights relating to the second reservoir. For example, the computing device 140 can determine predicted reservoir performance, carbon intensity, and other suitable information relating to the second reservoir as the analogue of the reservoir.

At block 506, the computing device 140 generates, upon determining that the second reservoir is an analogue of the reservoir, a model for the second reservoir. In some examples, the model can be a 3D subsurface model of the reservoir. The model for the second reservoir may be used to estimate properties of the second reservoir. The model may be a static reservoir model, a dynamic reservoir model, or any other suitable type of reservoir model.

Figure 6:
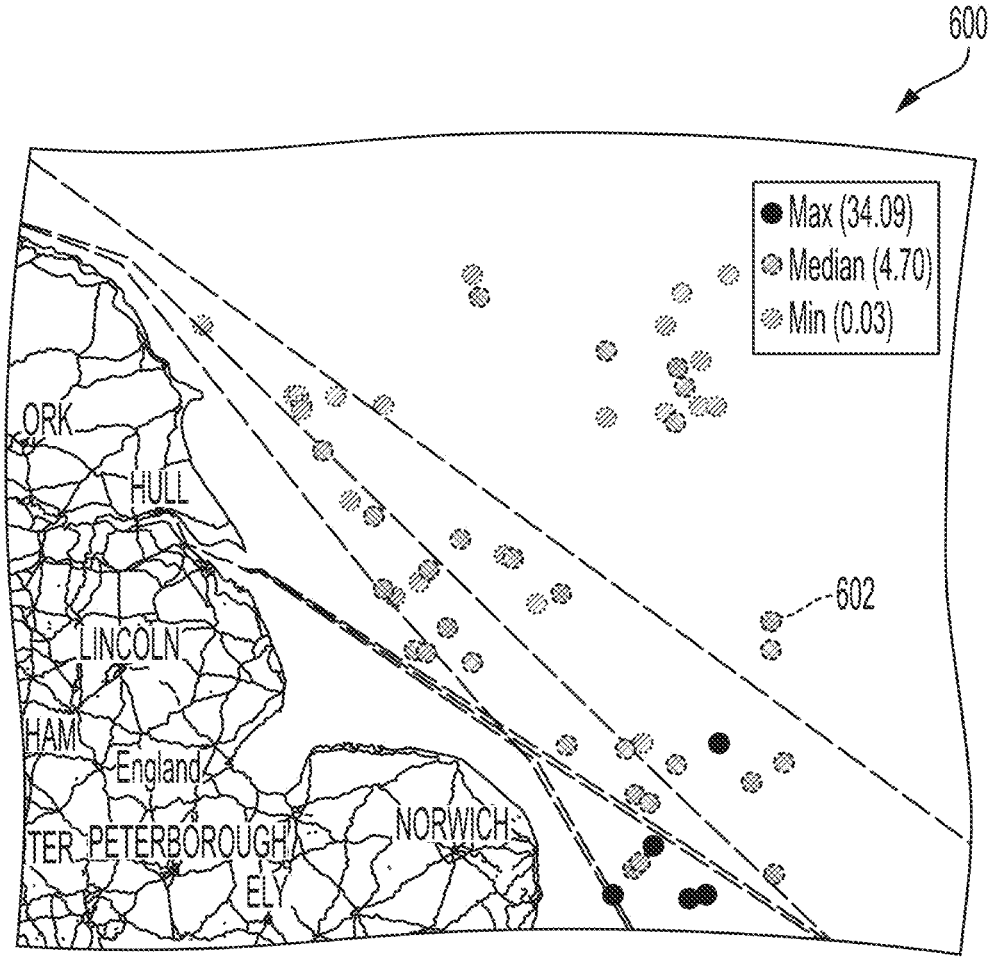
FIG. 6 is an example of a graphical user interface that can display well locations with corresponding heterogeneity values according to one example of the present disclosure.

FIG. 6 is an example of a graphical user interface 600 that can display well locations 602 with corresponding heterogeneity values according to one example of the present disclosure. In some examples, the graphical user interface 600 may display a heterogeneity index at each well location 602. The heterogeneity index may indicate a lateral heterogeneity of a reservoir, a vertical heterogeneity of the reservoir, or a total heterogeneity index of the reservoir. In some examples, the heterogeneity index may be color-coded, where each color may correspond to a value of the heterogeneity index.

In some examples, the graphical user interface 600 may include one or more interactive elements that can be used by an entity for displaying a property of the reservoir. For example, an entity may interact with the one or more interactive elements of the graphical user interface to display wireline log data associated with a well location 602. The graphical user interface 600 may be generated by a computing device 140 and may be output by a display device that can be communicatively coupled to the computing device 140.

In some aspects, systems, methods, and non-transitory computer-readable mediums for determining a heterogeneity and score of a reservoir are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processor; and a non-transitory computer-readable medium comprising instructions that are executable by the processor to cause the processor to perform operations comprising: receiving a wireline log associated with a well that is positioned in a subterranean formation that includes a reservoir; determining, using the wireline log, at least one statistical parameter for an interval of the well; determining, using the at least one statistical parameter, a vertical heterogeneity of the reservoir; determining, using the vertical heterogeneity, a score associated with the reservoir, the score indicating an extraction difficulty and a carbon intensity of the reservoir; and outputting the score for optimizing a drilling location.

Example 2 is the system of example 1, wherein the operations further comprise: generating a plurality of synthetic wireline logs associated with a plurality of synthetic wells; determining a plurality of correlation coefficients for the plurality of synthetic wireline logs; determining a first correlation coefficient for the wireline log associated with the well and a second correlation coefficient for a second wireline log associated with a second well in a second reservoir; and determining, by comparing the first correlation coefficient with the second correlation coefficient and the plurality of correlation coefficients associated with the synthetic wireline logs, a lateral heterogeneity between the reservoir and the second reservoir.

Example 3 is the system of any of examples 1-2, wherein the operations further comprise determining, using heterogeneity metrics relating to the reservoir and the second reservoir, that the second reservoir is an analogue of the reservoir.

Example 4 is the system of any of examples 1-3, wherein the operations further comprise generating, in response to determining that the second reservoir is the analogue of the reservoir, a subsurface model for determining the vertical heterogeneity of the second reservoir.

Example 5 is the system of example 1, wherein the operations further comprise generating delta data for the wireline log for determining the at least one statistical parameter for the interval of the well, wherein the delta data comprises a plurality of differences between a plurality of consecutive samples in the wireline log, and wherein the statistical parameter includes at least a delta variance of the delta data.

Example 6 is the system of example 1, wherein the operations further comprise: receiving seismic data for the subterranean formation; and analyzing the seismic data for determining a seismic-scale heterogeneity associated with the reservoir.

Example 7 is the system of example 1, wherein the operations further comprise generating a graphical user interface comprising a plurality of well locations and a plurality of total heterogeneity indices associated with the plurality of well locations.

Example 8 is a method comprising: receiving, by a processor, a wireline log associated with a well that is positioned in a subterranean formation that includes a reservoir; determining, by the processor and using the wireline log, at least one statistical parameter for an interval of the well; determining, by the processor and using the at least one statistical parameter, a vertical heterogeneity of the reservoir; determining, by the processor and using the vertical heterogeneity, a score associated with the reservoir, the score indicating an extraction difficulty and a carbon intensity of the reservoir; and outputting, by the processor, the score for optimizing a drilling location.

Example 9 is the method of example 8, further comprising: generating, by the processor, a plurality of synthetic wireline logs associated with a plurality of synthetic wells; determining, by the processor, a plurality of correlation coefficients for the plurality of synthetic wireline logs; determining, by the processor, a first correlation coefficient for the wireline log associated with the well and a second correlation coefficient for a second wireline log associated with a second well in a second reservoir; and determining, by the processor and by comparing the first correlation coefficient with the second correlation coefficient and the plurality of correlation coefficients associated with the synthetic wireline logs, a lateral heterogeneity between the reservoir and the second reservoir.

Example 10 is the method of any of examples 8-9, further comprising determining, using heterogeneity metrics relating to the reservoir and the second reservoir, that the second reservoir is an analogue of the reservoir.

Example 11 is the method of any of examples 8-10, further comprising generating, in response to determining that the second reservoir is the analogue of the reservoir, a subsurface model for determining the vertical heterogeneity of the second reservoir.

Example 12 is the method of example 8, further comprising generating, by the processor, delta data for the wireline log for determining the at least one statistical parameter for the interval of the well, wherein the delta data comprises a plurality of differences between a plurality of consecutive samples in the wireline log, and wherein the statistical parameter includes at least a delta variance of the delta data.

Example 13 is the method of example 8, further comprising: receiving, by the processor, seismic data for the subterranean formation; and analyzing, by the processor, the seismic data for determining a seismic-scale heterogeneity associated with the reservoir.

Example 14 is the method of example 8, further comprising generating, by the processor, a graphical user interface comprising a plurality of well locations and a plurality of total heterogeneity indices associated with the plurality of well locations.

Example 15 is a non-transitory computer-readable medium comprising instructions that are executable by a processor for causing the processor to perform operations comprising: receiving a wireline log associated with a well that is positioned in a subterranean formation that includes a reservoir; determining, using the wireline log, at least one statistical parameter for an interval of the well; determining, using the at least one statistical parameter, a vertical heterogeneity of the reservoir; determining, using the vertical heterogeneity, a score associated with the reservoir, the score indicating an extraction difficulty and a carbon intensity of the reservoir; and outputting the score for optimizing a drilling location.

Example 16 is the non-transitory computer-readable medium of example 15, wherein the operations further comprise: generating a plurality of synthetic wireline logs associated with a plurality of synthetic wells; determining a plurality of correlation coefficients for the plurality of synthetic wireline logs; determining a first correlation coefficient for the wireline log associated with the well and a second correlation coefficient for a second wireline log associated with a second well in a second reservoir; and determining, by comparing the first correlation coefficient with the second correlation coefficient and the plurality of correlation coefficients associated with the synthetic wireline logs, a lateral heterogeneity between the reservoir and the second reservoir.

Example 17 is the non-transitory computer-readable medium of any of examples 15-16, wherein the operations further comprise determining, using heterogeneity metrics between the reservoir and the second reservoir, that the second reservoir is an analogue of the reservoir.

Example 18 is the non-transitory computer-readable medium of any of examples 15-17, wherein the operations further comprise generating, in response to determining that the second reservoir is the analogue of the reservoir, a subsurface model for determining the vertical heterogeneity of the second reservoir.

Example 19 is the non-transitory computer-readable medium of example 15, wherein the operations further comprise generating delta data for the wireline log for determining the at least one statistical parameter for the interval of the well, wherein the delta data comprises a plurality of differences between a plurality of consecutive samples in the wireline log, and wherein the statistical parameter includes at least a delta variance of the delta data.

Example 20 is the non-transitory computer-readable medium of example 15, wherein the operations further comprise: receiving seismic data for the subterranean formation; and analyzing the seismic data for determining a seismic-scale heterogeneity associated with the reservoir.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processor; and a non-transitory computer-readable medium comprising instructions that are executable by the processor to cause the processor to perform operations comprising:

receiving a wireline log associated with a well that is positioned in a subterranean formation that includes a reservoir;

determining, using the wireline log, at least one statistical parameter for an interval of the well;

generating delta data for the wireline log for determining the at least one statistical parameter for the interval of the well, wherein the delta data comprises one or more differences between two or more consecutive samples in the wireline log;

determining, using the at least one statistical parameter, a vertical heterogeneity of the reservoir;

determining, using the vertical heterogeneity, a score associated with the reservoir, the score indicating an extraction difficulty and a carbon intensity of the reservoir; and outputting the score for optimizing a drilling location.

2. The system of claim 1, wherein the operations further comprise:

generating a plurality of synthetic wireline logs associated with a plurality of synthetic wells;

determining a plurality of correlation coefficients for the plurality of synthetic wireline logs;

determining a first correlation coefficient for the wireline log associated with the well and a second correlation coefficient for a second wireline log associated with a second well in a second reservoir; and determining, by comparing the first correlation coefficient with the second correlation coefficient and the plurality of correlation coefficients associated with the synthetic wireline logs, a lateral heterogeneity between the reservoir and the second reservoir.

3. The system of claim 2, wherein the operations further comprise determining, using heterogeneity metrics relating to the reservoir and the second reservoir, that the second reservoir is an analogue of the reservoir.

4. The system of claim 3, wherein the operations further comprise generating, in response to determining that the second reservoir is the analogue of the reservoir, a subsurface model for determining the vertical heterogeneity of the second reservoir.

5. The system of claim 1, wherein the delta data comprises a plurality of differences between a plurality of consecutive samples in the wireline log, and wherein the statistical parameter includes at least a delta variance of the delta data.

6. The system of claim 1, wherein the operations further comprise:

receiving seismic data for the subterranean formation; and analyzing the seismic data for determining a seismic-scale heterogeneity associated with the reservoir.

7. The system of claim 1, wherein the operations further comprise generating a graphical user interface comprising a plurality of well locations and a plurality of total heterogeneity indices associated with the plurality of well locations.

8. A method comprising:

receiving, by a processor, a wireline log associated with a well that is positioned in a subterranean formation that includes a reservoir;

determining, by the processor and using the wireline log, at least one statistical parameter for an interval of the well;

generating, by the processor, delta data for the wireline log for determining the at least one statistical parameter for the interval of the well, wherein the delta data comprises one or more differences between two or more consecutive samples in the wireline log;

determining, by the processor and using the at least one statistical parameter, a vertical heterogeneity of the reservoir;

determining, by the processor and using the vertical heterogeneity, a score associated with the reservoir, the score indicating an extraction difficulty and a carbon intensity of the reservoir; and outputting, by the processor, the score for optimizing a drilling location.

9. The method of claim 8, further comprising:

generating, by the processor, a plurality of synthetic wireline logs associated with a plurality of synthetic wells;

determining, by the processor, a plurality of correlation coefficients for the plurality of synthetic wireline logs;

determining, by the processor, a first correlation coefficient for the wireline log associated with the well and a second correlation coefficient for a second wireline log associated with a second well in a second reservoir; and determining, by the processor and by comparing the first correlation coefficient with the second correlation coefficient and the plurality of correlation coefficients associated with the synthetic wireline logs, a lateral heterogeneity between the reservoir and the second reservoir.

10. The method of claim 9, further comprising determining, using heterogeneity metrics relating to the reservoir and the second reservoir, that the second reservoir is an analogue of the reservoir.

11. The method of claim 10, further comprising generating, in response to determining that the second reservoir is the analogue of the reservoir, a subsurface model for determining the vertical heterogeneity of the second reservoir.

12. The method of claim 8, wherein the delta data comprises a plurality of differences between a plurality of consecutive samples in the wireline log, and wherein the statistical parameter includes at least a delta variance of the delta data.

13. The method of claim 8, further comprising:

receiving, by the processor, seismic data for the subterranean formation; and analyzing, by the processor, the seismic data for determining a seismic-scale heterogeneity associated with the reservoir.

14. The method of claim 8, further comprising generating, by the processor, a graphical user interface comprising a plurality of well locations and a plurality of total heterogeneity indices associated with the plurality of well locations.

15. A non-transitory computer-readable medium comprising instructions that are executable by a processor for causing the processor to perform operations comprising:

receiving a wireline log associated with a well that is positioned in a subterranean formation that includes a reservoir;

determining, using the wireline log, at least one statistical parameter for an interval of the well;

generating delta data for the wireline log for determining the at least one statistical parameter for the interval of the well, wherein the delta data comprises one or more differences between two or more consecutive samples in the wireline log;

determining, using the at least one statistical parameter, a vertical heterogeneity of the reservoir;

determining, using the vertical heterogeneity, a score associated with the reservoir, the score indicating an extraction difficulty and a carbon intensity of the reservoir; and outputting the score for optimizing a drilling location.

16. The non-transitory computer-readable medium of claim 15, wherein the operations further comprise:

generating a plurality of synthetic wireline logs associated with a plurality of synthetic wells;

determining a plurality of correlation coefficients for the plurality of synthetic wireline logs;

determining a first correlation coefficient for the wireline log associated with the well and a second correlation coefficient for a second wireline log associated with a second well in a second reservoir; and determining, by comparing the first correlation coefficient with the second correlation coefficient and the plurality of correlation coefficients associated with the synthetic wireline logs, a lateral heterogeneity between the reservoir and the second reservoir.

17. The non-transitory computer-readable medium of claim 16, wherein the operations further comprise determining, using heterogeneity metrics between the reservoir and the second reservoir, that the second reservoir is an analogue of the reservoir.

18. The non-transitory computer-readable medium of claim 17, wherein the operations further comprise generating, in response to determining that the second reservoir is the analogue of the reservoir, a subsurface model for determining the vertical heterogeneity of the second reservoir.

19. The non-transitory computer-readable medium of claim 15, wherein the delta data comprises a plurality of differences between a plurality of consecutive samples in the wireline log, and wherein the statistical parameter includes at least a delta variance of the delta data.

20. The non-transitory computer-readable medium of claim 15, wherein the operations further comprise:

receiving seismic data for the subterranean formation; and analyzing the seismic data for determining a seismic-scale heterogeneity associated with the reservoir.

* * * * *